US007025028B2

(12) United States Patent
Dölker

(10) Patent No.: US 7,025,028 B2
(45) Date of Patent: Apr. 11, 2006

(54) METHOD FOR CONTROLLING AND ADJUSTING THE STARTING MODE OF AN INTERNAL COMBUSTION ENGINE

(75) Inventor: Armin Dölker, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 10/495,658

(22) PCT Filed: Nov. 12, 2002

(86) PCT No.: PCT/EP02/12600

§ 371 (c)(1),
(2), (4) Date: May 17, 2004

(87) PCT Pub. No.: WO03/042523

PCT Pub. Date: May 22, 2003

(65) Prior Publication Data

US 2005/0011496 A1 Jan. 20, 2005

(30) Foreign Application Priority Data

Nov. 17, 2001 (DE) ..... 101 56 637

(51) Int. Cl.
*F02M 37/04* (2006.01)

(52) U.S. Cl. ..... 123/179.17; 123/456; 123/458

(58) Field of Classification Search ..... 123/457, 123/458, 456, 446, 447, 462, 179.16, 179.17, 123/514, 198 D, 479, 359
See application file for complete search history.

(56) References Cited

U.S. PATENT DOCUMENTS

| | | | | |
|---|---|---|---|---|
| 6,035,829 | A * | 3/2000 | Hartke et al. | 123/447 |
| 6,293,251 | B1 * | 9/2001 | Hemmerlein et al. | 123/447 |
| 6,378,498 | B1 * | 4/2002 | Kohketsu et al. | 123/447 |
| 6,578,553 | B1 * | 6/2003 | Schubert et al. | 123/458 |

FOREIGN PATENT DOCUMENTS

| | | |
|---|---|---|
| DE | 199 16 100 A1 | 10/2000 |
| EP | 0 896 145 A2 | 10/1999 |

* cited by examiner

*Primary Examiner*—Thomas Moulis
(74) *Attorney, Agent, or Firm*—Crowell & Moring LLP

(57) ABSTRACT

For controlling and regulating the startup operation of an internal combustion engine (1) a method is proposed in which a rail pressure is compared with a limit value on activation of the startup operation. Depending on this comparison, a first or second mode is set, whereby the rail pressure (pCR) for the startup operation is controlled in the first mode and is regulated in the second mode. It is provided according to this invention that after the initial setting of the second mode, that mode is retained for the remaining startup operation. This achieves the advantage that high-pressure fluctuations due to alternating modes are effectively prevented.

14 Claims, 4 Drawing Sheets

METHOD FOR CONTROLLING AND ADJUSTING THE STARTING MODE OF AN INTERNAL COMBUSTION ENGINE

This application claims the priority of German patent application no. 101 56 637.9, filed Nov. 17, 2001, and International application no. PCT/EP02/12600, filed Nov. 12, 2002, the disclosure of which are expressly incorporated by reference herein.

BACKGROUND AND SUMMARY OF THE INVENTION

This invention relates to a method of controlling and regulating the startup operation of an internal combustion engine.

The startup operation of an internal combustion engine is critical with regard to maintaining the exhaust gas limit values. A rapid pressure buildup in the fuel supply and an early transition to pressure regulated operation are deciding factors here. German Patent DE 199 16 100 A1 describes a method for the startup of an internal combustion engine having a common rail injection system. On activation of the startup operation, a first mode is set. In the first mode, an attempt is made to increase the rail pressure as rapidly as possible. During startup, the rail pressure and/or the rotational speed of the internal combustion engine are compared with a limit value. As long as they remain beneath the limit value, the first mode remains set and the pressure is built up in the rail in a controlled fashion. If these values are above the limit value, a second mode is set. In the second mode the regulation of the rail pressure is activated. However, the rail pressure may drop below the limit value again due to the injected fuel. Therefore, the first mode is set again. Thereafter, if the rail pressure again exceeds the limit value, the system switches back to the second mode. This change in modes is problematical because it causes pressure fluctuations during the startup operation.

The object of this invention is to make the startup operation more reliable.

This object is achieved by a method of controlling and regulating the startup operation in which the first time the second mode is set, it is retained for the remaining startup operation. The rail pressure is thus regulated even when it again falls below a limit value, e.g., a regulator enable pressure. The regulator enable pressure is understood to be the pressure at which the high-pressure regulation is enabled. In the first mode, a control signal for a pressure control means, in particular an intake throttle, is calculated in a form such that full delivery of fuel is ensured. An adjustment of the control signal is achieved when it is determined as a function of the engine rotational speed. Emergency operation is activated in the event of a failure of the rail pressure sensor. When emergency operation is activated, the engine rotational speed is used as the authoritative characteristic parameter for the startup operation.

This invention offers the advantage that a stable steady state of the overall system is achieved at an earlier point in time. For implementation of the function, no additional sensor signals or output signals for final control elements are necessary, so that they can be applied with little effort.

Other objects, advantages and novel features of the present invention will become apparent from the following detailed description of the invention when considered in conjunction with the accompanying drawings.

DETAILED DESCRIPTION OF THE DRAWINGS

Figure 1:
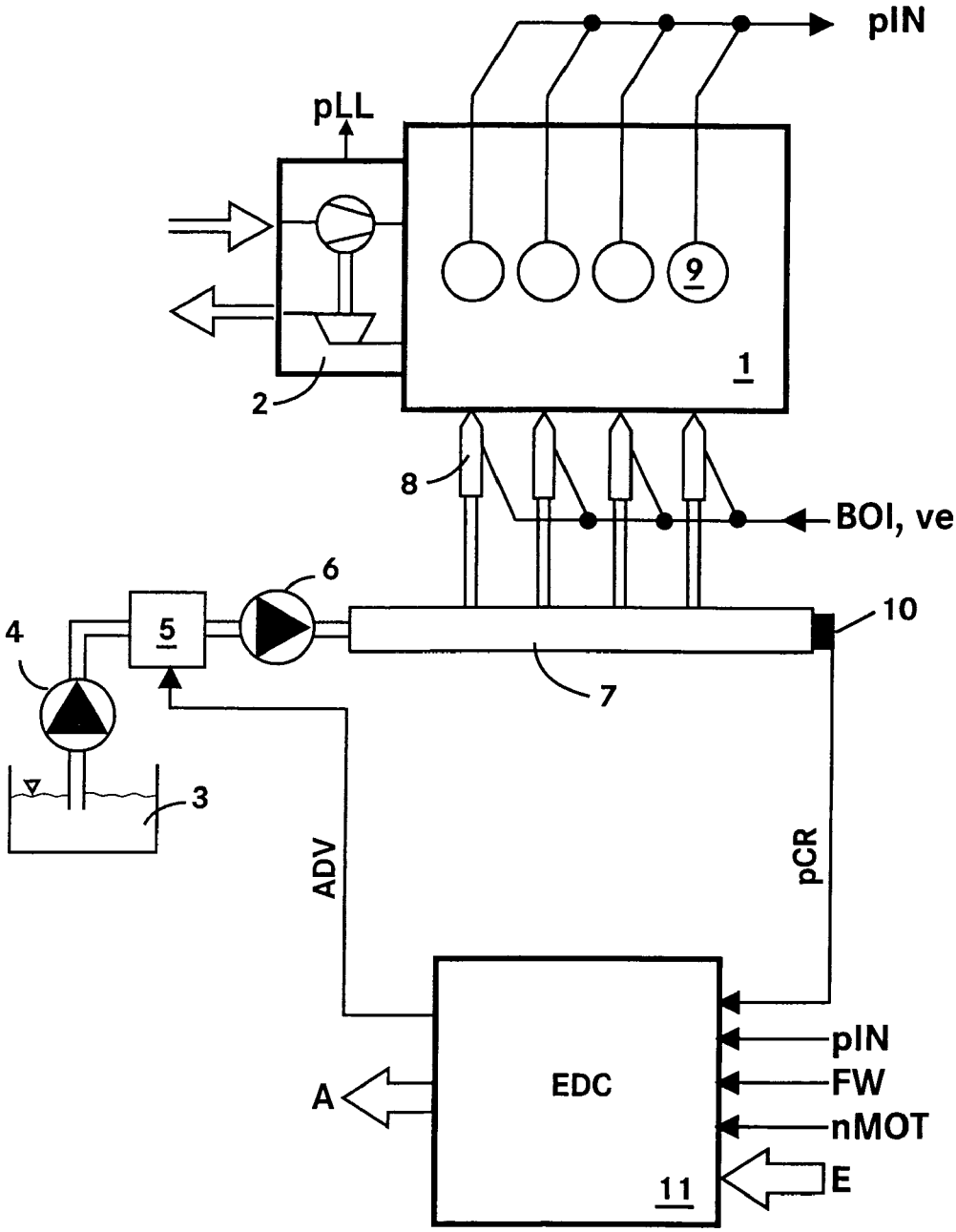
FIG. 1 a block diagram of the overall system
FIG. 2 a time chart
FIG. 3 a program flow chart, normal operation
FIG. 4 a program flow chart, emergency operation

FIG. 1 shows a block schematic of an internal combustion engine 1 having a common rail injection system. The common rail injection system comprises a first pump 4, an intake throttle 5, a second pump 6, a high-pressure storage device and injectors 8. In the remaining text the high-pressure storage device is referred to as rail 7. The first pump 4 pumps the fuel out of a fuel tank 3 to the intake throttle 5. The pressure level downstream from the first pump 4 amounts to 3 bar, for example. The volume flow to the second pump 6 is determined by the intake throttle 5. The second pump 6 in turn pumps the fuel under a high pressure into the rail 7. The pressure level in the rail 7 amounts to more than 1200 bar in diesel engines. The injectors 8 are connected to the rail 7. The fuel is injected through the injectors 8 into the combustion chambers of the internal combustion engine 1.

The internal combustion engine 1 is controlled and regulated by an electronic controller 11 (EDC). The EDC 11 includes the usual components of a microcomputer system such as a microprocessor, I/O modules, buffer and memory modules (EEPROM, RAM). Operating data relevant for operation of the internal combustion engine 1 is stored in engine characteristics maps, i.e., characteristic lines, in the memory modules. The electronic controller 11 uses this data to calculate the output quantities from the input quantities. FIG. 1 shows as an example the following input quantities: a rail pressure pCR, which is measured by a rail pressure sensor 10, the rotational speed nMOT of the internal combustion engine 1, a requested power FW, a cylinder internal pressure pIN, which is measured by means of pressure sensors 9 and an input quantity E. Under the input quantity E are subsumed, for example, the charging air pressure pLL of the turbocharger 2 and the temperatures of the coolant and lubricant. FIG. 1 shows, as output quantities of the electronic controller 11, a signal ADV for controlling the intake throttle 5 and an output quantity A. The output quantity A is representative of the additional actuating signals for controlling and regulating the internal combustion engine 1, e.g., the beginning of injection BOI and the injection quantity ve. In practice, the control signal ADV is a PWM signal (pulse-width modulated) by which a corresponding electric current value is set for the intake throttle 5. At an electric current value of almost zero, the intake throttle 5 is completely opened, i.e., the volume flow delivered by the first pump 4 goes to the second pump 6 without hindrance. Of course triggering into a positive logic is also possible, i.e., at a maximum current level the intake throttle 5 is completely opened. In normal operation the rail pressure pCR is usually operated in a control circuit. The control signal ADV here corresponds to the manipulated variable. The intake throttle 5, the second pump 6 and the rail 7 correspond to the regulating zone.

Figure 2A:
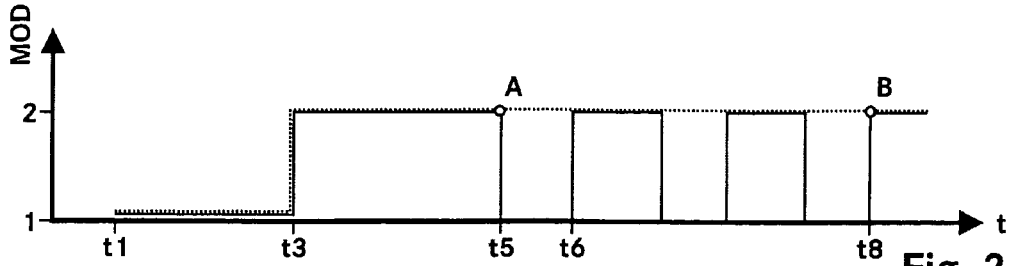
Figure 2B:
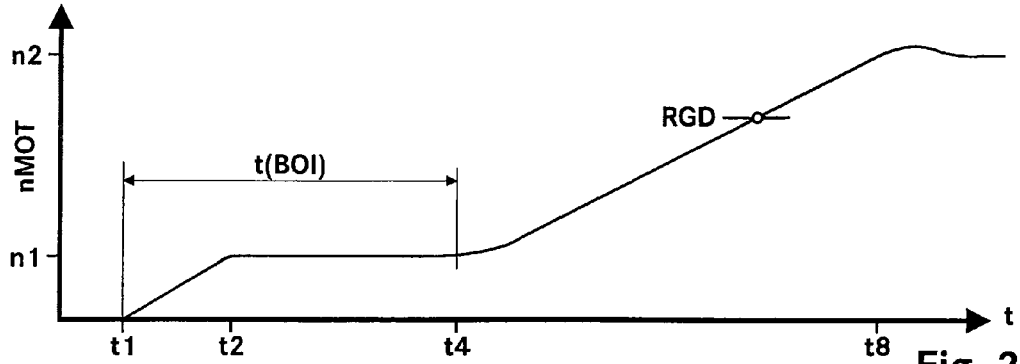
Figure 2C:
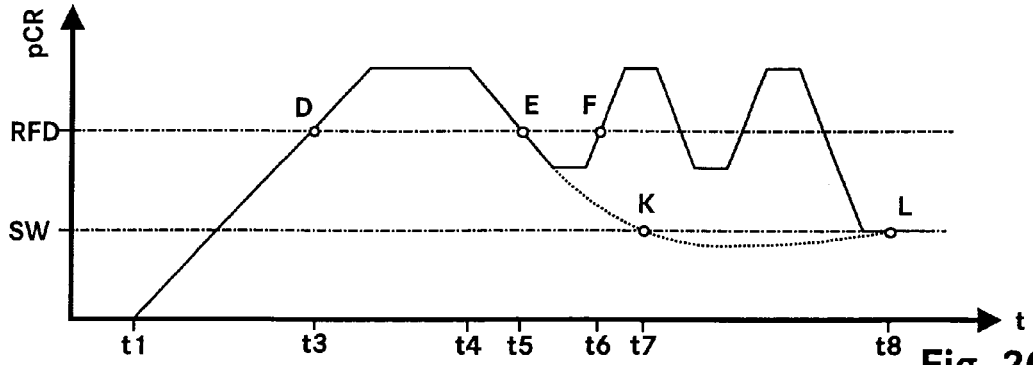
Figure 2D:
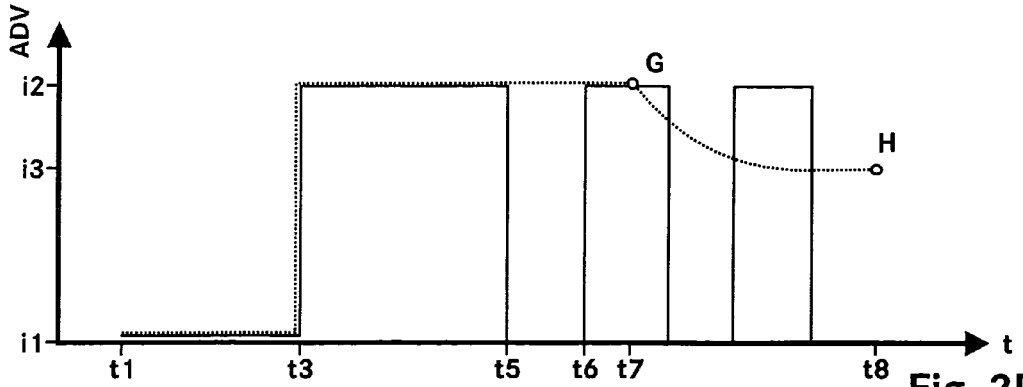

FIG. 2 consists of partial FIGS. 2A through 2D. This shows the startup operation for an internal combustion engine in the form of plots over time: FIG. 2A shows a diagram of state of the modes; FIG. 2B shows the engine rotational speed NMOT; FIG. 2C shows the rail pressure pCR and FIG. 2D shows the control signal ADV corresponding to the electric current value for the intake throttle 5. Two cases are differentiated in FIGS. 2A, 2C and 2D. The solid line shows the signal characteristic for a startup operation according to the related art. The dotted line shows the signal characteristic according to this invention. FIG. 2C shows a rail pressure setpoint value SW and a limit value parallel to the abscissa. The limit value corresponds in practice to a regulator enable pressure RFD. In the method described below, a constant setpoint value SW is assumed.

The method according to the related art takes place as follows:

At time t1 the startup operation is activated by a flow of current to the starter. The crankshaft of the internal combustion engine begins to turn. However no injection takes place yet. Likewise at time t1, a timer module t(BOI) is started and the first mode is set. In FIG. 2A this corresponds to a signal level of one (MOD=1). After point in time t1, the engine rotational speed NMOT increases until reaching starter rotational speed n1 at time t2. Since the second pump 6 is mechanically connected to the crankshaft, it begins to pump fuel into the rail 7 when the crankshaft is turned. This causes the rail pressure pCR to rise. In the period of time from t1 to t3 the control signal ADV for the intake throttle 5 is selected so as to achieve a maximum delivery of fuel. In the exemplary embodiment shown here, a negative triggering logic has been assumed. This means that smaller electric current values produce a greater opening of the intake throttle, i.e., a decreasing throttling. For the maximum delivery of fuel, the control signal ADV is set at a first current value i1. This first current value i1 may be zero (i1=0). In FIG. 2D the first current value i1 is shown as a constant value over the period of time t1 through t3. The first current value i1 may also be calculated as a function of the engine rotational speed NMOT.

At time t3, the rail pressure pCR exceeds the regulator enable pressure RFD (point D). As a result of this the second mode is set (MOD=2). In FIG. 2A, the signal value therefore changes from one to two. At the same time, the control signal ADV of the throttle valve 5 is set at a second current value i2. After time t3, i.e., when the second mode is set, the rail pressure pCR is regulated. At point D there is a negative control deviation. This corresponds to the difference between the rail pressure pCR at point D and the setpoint value SW as depicted in FIG. 2C.

At time t4 the timer module t(BOI) has expired so that the injection into the combustion chambers of the internal combustion engine 1 begins. This causes the rotational speed rLMOT of the internal combustion engine to increase. Because of the quantity of fuel withdrawn, the rail pressure pCR drops until at time t5 it falls below the regulator enable pressure RFD at point E. As a follow-up reaction, the first mode is set again at time t5, i.e., the signal characteristic in FIG 2A changes to a value of one. At the same time the control signal ADV is reset at the first current value ii. Since the intake throttle 5 is completely opened, the rail pressure pCR begins to rise again until at time t6 it again exceeds the regulator enable pressure RFD at point F. As a follow-up reaction, the second mode is again set and again the second current value i2 is calculated for the control signal ADV. This oscillation in the rail pressure pCR, the modes and the control signal ADV proceeds until time t8. At time t8, the engine rotational speed nMOT has reached the idling value n2. Only after this point in time is the second mode retained. Only then is the overall system in a stabilized state. opened, the rail pressure pCR begins to rise again until at time t6 it again exceeds the regulator enable pressure RFD at point F. As a follow-up reaction, the second mode is again set and again the second current value i2 is calculated for the control signal ADV. This oscillation in the rail pressure pCR, the modes and the control signal ADV proceeds until time t8. At time t8, the engine rotational speed nMOT has reached the idling value n2. Only after this point in time is the second mode retained. Only then is the overall system in a stabilized state.

The method according to this invention takes place as follows:

Up to time t5 the signal curve corresponds to the preceding description. However, at time t5 the second mode is retained. The signal curve in FIG. 2A therefore retains a value of 2 at point A. The second mode remains set until time t8 (point B). The control signal ADV remains at the second current value i2 because of the negative control deviation. Up to time t7 the control deviation is zero. Consequently, the rail pressure pCR falls below the rail pressure setpoint value SW. Due to the fact that the control deviation is now positive, the control signal ADV for the intake throttle 5 is calculated according to the set of curves with points G and H. Point H corresponds to a third current value i3, for example. For the rail pressure pCR, this yields a set of curves with the points K and L. At time t8 the starting process is ended on reaching the idling rotational speed n2.

To nevertheless ensure startup of the internal combustion engine in the event of a failure of the rail pressure sensor 10, the engine rotational speed NMOT may be used as the characteristic quantity for switching from the first mode to the second mode instead of using the rail pressure pCR. For example, the system will change from the first mode to the second mode when the engine rotational speed NMOT exceeds a limit value, the regulator enable rotational speed RGD. The regulator release rotational speed is shown in FIG. 2B.

Figure 3:
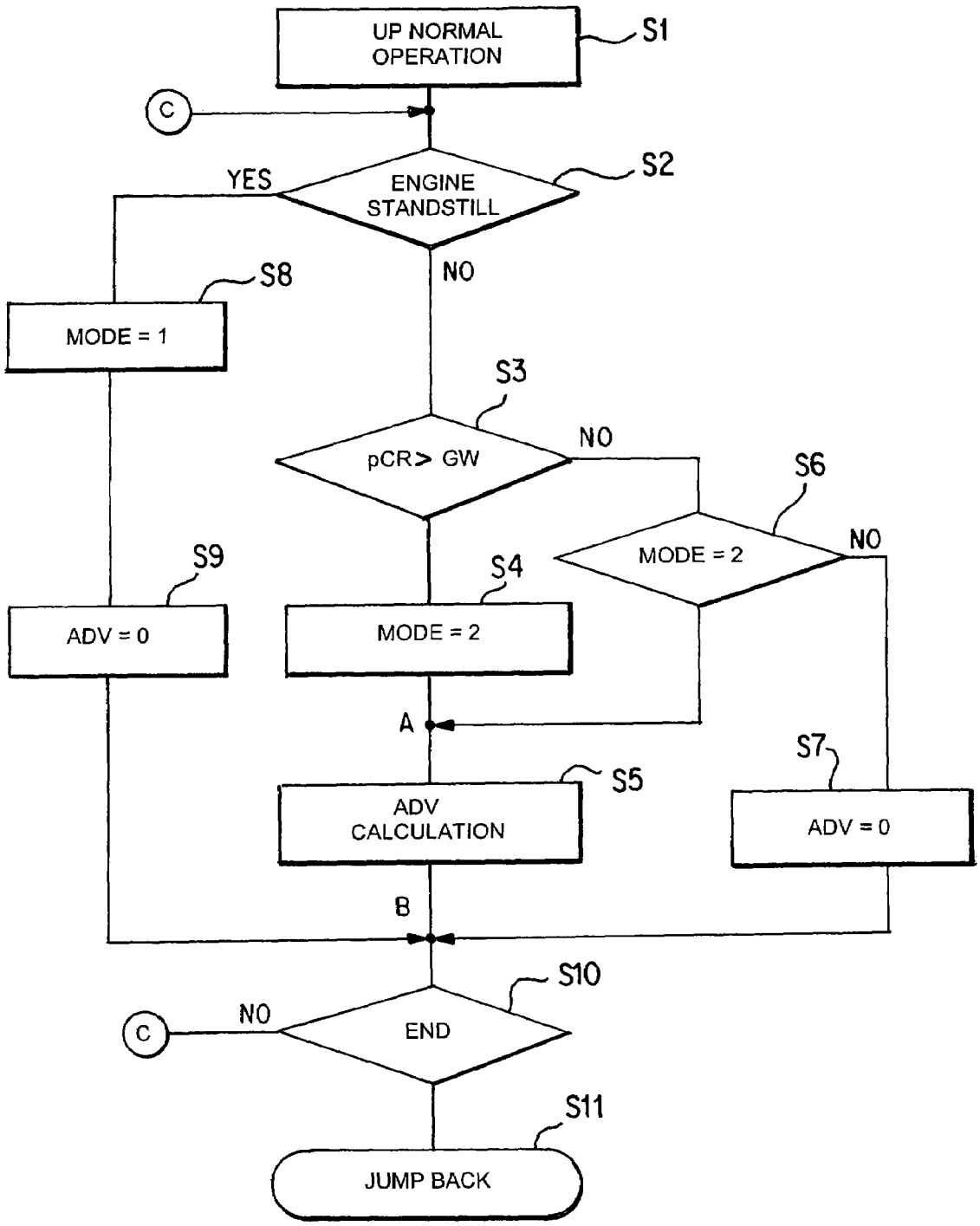

FIG. 3 shows a program flow chart for the sequence of the method in normal operation. At step S, the normal operation subprogram is called up. Normal operation occurs when the measured values of the rail pressure sensor 10 are plausible. At S2 a check is performed to determine whether the engine is at a standstill, i.e., the initialization phase is still underway. If the internal combustion engine has not yet been started, a loop is run through with steps S8 and S9, i.e., the first mode is set and the control signal ADV is set at zero. If the internal combustion engine has already been started (query S2 is negative), a check is performed at step S3 to determine whether the rail pressure pCR is greater than a limit value GW. In practice, this limit value GW corresponds to the regulator enable pressure (RFD), e.g., 650 bar. If the rail pressure pCR is still below the limit value, a check is performed at S6 to determine whether the second mode has already been set. If this is not the case, then the triggering signal ADV is set at zero at S7 and the program flow chart branches off to S10. If the query in step S6 reveals that the second mode has already been set then the program flow chart branches back to point A.

If the rail pressure pCR exceeds the limit value GW (the query S3 is positive) the second mode is set at S4. Then at S5 the triggering signal ADV is calculated and set at the corresponding electric current value, e.g., i2. At S10 a check is performed to determine whether an end criterion is present. An end criterion may be, for example, when the idling rotational speed n2 is reached. If no end criterion can be discerned, the program flow chart branches off to point C. If the end criterion is present, the program jumps back into the main program at S11.

Figure 4:
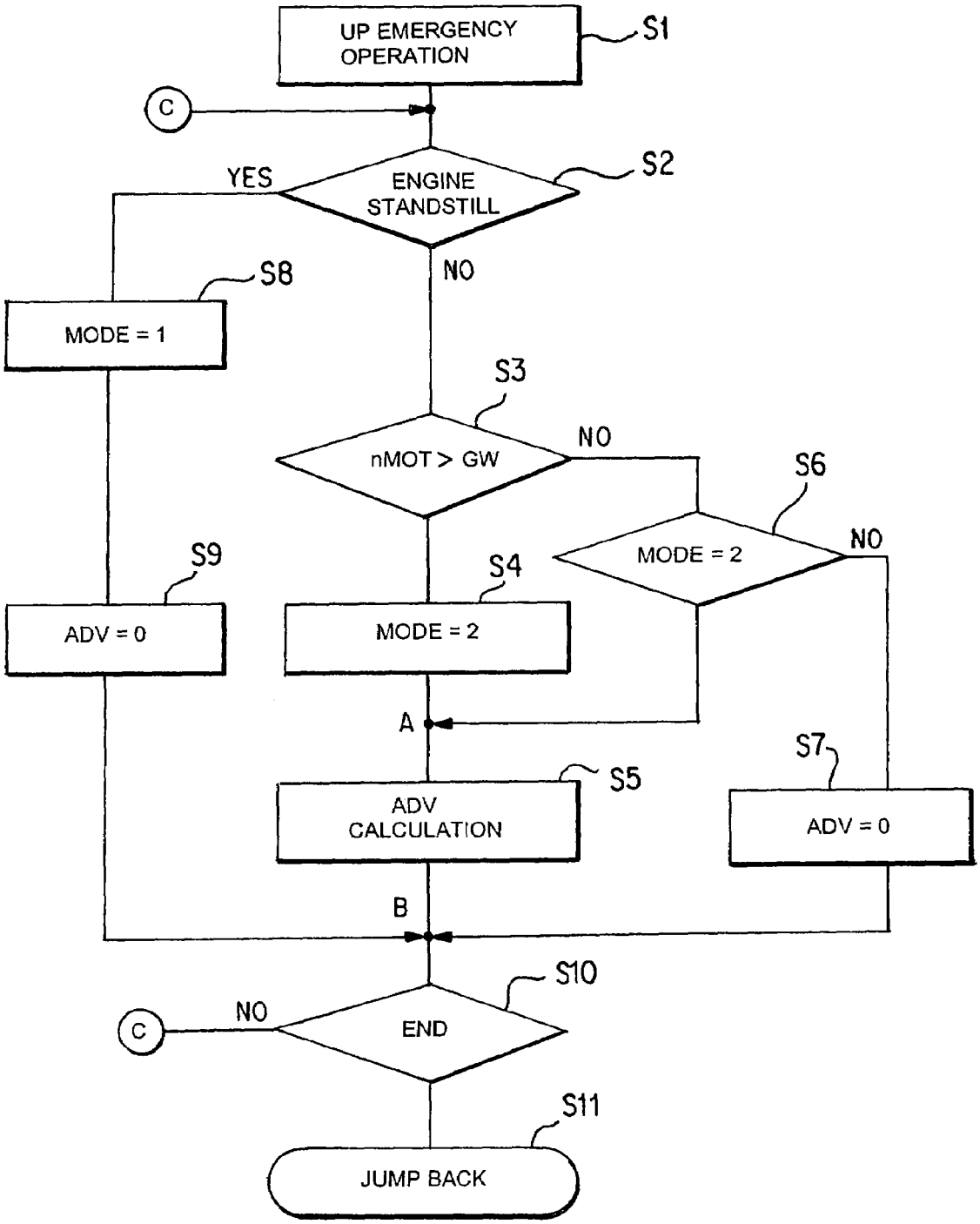

FIG. 4 shows a program flow chart for the method in emergency operation. The emergency operation subprogram is then called up when the measured values of the rail pressure sensor 10 are not plausible, e.g., when there is a short circuit. The emergency operation subprogram is also called up when a defective rail pressure sensor has already been detected in operation of the internal combustion engine before shutdown. The program flow chart according to FIG. 4 differs from the program flow chart of FIG. 3 in step S3 where the query is not regarding the rail pressure pCR but instead the engine rotational speed nMOT. The remaining sequence then corresponds to that in FIG. 3 so that what was said there also applies here.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof. there is a short circuit. The emergency operation subprogram is also called up when a defective rail pressure sensor has already been detected in operation of the internal combustion engine before shutdown. The program flow chart according to FIG. 4 differs from the program flow chart of FIG. 3 in step S3 where the query is not regarding the rail pressure pCR but instead the engine rotational speed NMOT. The remaining sequence then corresponds to that in FIG. 3 so that what was said there also applies here.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claim is:

1. Method of controlling and regulating the startup operation of an internal combustion engine in which a rail pressure is compared with a limit value on activation of the startup operation and a first or second mode is set as a function of this comparison, with the rail pressure being controlled in the first mode and the rail pressure being regulated in the second mode, wherein the first time the second mode is set, it is retained for the remaining startup operation.

2. Method of controlling and regulating as claimed in claim 1, wherein in the first mode a control signal for an intake throttle is set at a first electric current value for full delivery of fuel.

3. Method of controlling and regulating as claimed in claim 2, wherein the first current value is set at a constant value.

4. Method of controlling and regulating as claimed in claim 2, wherein the first current value is calculated as a function of an engine rotational speed.

5. Method of controlling and regulating as claimed in claim 1 wherein the rail pressure is checked for plausibility, and emergency operation is activated when implausible values are detected for the rail pressure.

6. Method of control and regulating as claimed in claim 5, wherein in emergency operation the engine rotational speed is set as the defining characteristic quantity for the change from the first mode to the second mode.

7. Method of controlling and regulating as claimed in claim 6, wherein is a switch from the first mode to the second mode when the engine rotational speed exceeds a limit value.

8. Apparatus for controlling and regulating the startup operation of an internal combustion engine, comprising:

a fuel injection rail;

a fuel injection rail pressure sensor;

a fuel injection rail pressure regulator; and a fuel injection rail pressure controller, wherein the rail pressure controller compares a rail pressure sensed by the pressure sensor with a limit value on activation of the startup operation and sets a first or second mode for operation of the rail pressure regulator to control of rail pressure based on the results of the comparison, and wherein the first time the second mode is set, it is retained for the remainder of the startup operation.

9. Apparatus for controlling and regulating as claimed in claim 8, wherein the fuel injection rail pressure regulator is an intake throttle, and in the first mode the controller sets a control signal for the intake throttle at a first electric current value for full delivery of fuel.

10. Apparatus for controlling and regulating as claimed in claim 9, wherein the first current value is set at a constant value.

11. Apparatus for controlling and regulating as claimed in claim 9, wherein the first current value is calculated as a function of an engine rotational speed.

12. Apparatus for controlling and regulating as claimed in claim 9, wherein the rail pressure controller checks the rail pressure for plausibility, and activates emergency operation when implausible values are detected for the rail pressure.

13. Apparatus for controlling and regulating as claimed in claim 12, wherein in emergency operation the rail pressure controller determines whether to change from the first mode to the second mode based on the engine rotational speed.

14. Apparatus for controlling and regulating as claimed in claim 13, wherein the rail pressure controller sets the first mode to the second mode when the engine rotational speed exceeds a limit value.

* * * * *